US005193996A

United States Patent [19]

Mullen

[11] Patent Number: 5,193,996

[45] Date of Patent: Mar. 16, 1993

[54] METHOD AND SYSTEM FOR PRODUCING CARBON FIBERS

[75] Inventor: Charles K. Mullen, Anaheim Hills, Calif.

[73] Assignee: BP Chemicals (HITCO) Inc., Gardena, Calif.

[21] Appl. No.: 793,251

[22] Filed: Nov. 12, 1991

Related U.S. Application Data

[60] Continuation of Ser. No. 363,365, May 31, 1989, abandoned, which is a continuation of Ser. No. 147,105, Jan. 20, 1988, abandoned, which is a continuation of Ser. No. 865,165, May 20, 1986, abandoned, which is a division of Ser. No. 742,103, Jun. 5, 1985, Pat. No. 4,610,860, which is a continuation of Ser. No. 541,652, Oct. 13, 1983, abandoned.

[51] Int. Cl.[5] ..... F27B 9/28

[52] U.S. Cl. ..... 432/59; 423/447.7; 423/447.8; 34/156

[58] Field of Search ..... 34/155, 156, 23; 423/447.7, 447.8, 447.1, 447.2; 422/150, 198, 199, 202, 204, 233; 432/59

[56] References Cited

U.S. PATENT DOCUMENTS

| | | | |
|---|---|---|---|
| 3,618,914 | 11/1971 | Best | 266/3 |
| 3,745,104 | 7/1973 | Hou | 423/447.7 |
| 3,971,840 | 7/1976 | Economy | 264/231 |
| 4,217,090 | 8/1980 | Whike et al. | 432/8 |
| 4,301,136 | 11/1981 | Yamamoto et al. | 423/447.8 |
| 4,389,387 | 6/1983 | Miyamori et al. | 423/447.7 |
| 4,534,920 | 8/1985 | Yoshinaga et al. | 423/447.8 |
| 4,543,241 | 9/1985 | Yoshinori et al. | 423/447.8 |

*Primary Examiner*—Henry A. Bennet

*Attorney, Agent, or Firm*—Renner, Kenner, Greive, Bobak, Taylor and Weber

[57] ABSTRACT

High tensile carbon fibers are provided with a high yield process in which, after oxidation of a precursor, the fibers are first precarbonized in an inert atmosphere to to about 600° C. while imparting 5–10% stretch. In precarbonizing, the fibers are intially heated in a sweeping manner with substantial volumes of hot inert gas which is extracted along with products of decomposition before the fibers are cooled to a low, non-reactive exit temperature. The arrangement minimizes redeposition of tars on the fibers and stretches the fibers in a range in which substantial off-gassing occurs. Thereafter the fibers are finally carbonized at a higher temperature with a different tension being applied, to provide a more reliable less sensitive process that enables oxidation to be effected more rapidly.

27 Claims, 6 Drawing Sheets

METHOD AND SYSTEM FOR PRODUCING CARBON FIBERS

This is a continuation of co-pending application Ser. No. 07/363,365 filed on May 31, 1989 now abandoned which is a continuation of application Ser. No. 07/147,105 filed Jan. 20, 1988 now abandoned which is a continuation of Ser. No. 06/865,165 filed May 20, 1986 and now abandoned, which is a divisional of application Ser. No. 06/742,103 filed on Jun. 5, 1985 (now issued as U.S. Pat. No. 4,610,860), which is a continuation of application Ser. No. 06/541,652 filed Oct. 13, 1983 now abandoned.

BACKGROUND OF THE INVENTION

The present invention relates to the production of carbon fibers from carbon-containing precursor fibers such as polyacrylonitrile fibers, and particularly to methods and systems for processing such precursor fibers to provide high tensile carbon fibers with improved yield and uniformity.

A variety of methods have been employed for producing carbon fibers by first oxygenating and then carbonizing precursor fibers, such as polyacrylonitrile fibers, in an inert atmosphere. Most methods keep the fibers under tension, as by restraint against shrinkage, during at least some of the process steps. Tension during oxidation, also called stabilization, is a precondition to obtaining the levels of tensile strength and modulus of elasticity that are desired in the final product. Many variants have been employed in the carbonization phase, which takes the oxidized fibers to a higher, final temperature level within a relatively short time, using a nitrogen or other inert gas as the environment. Carbonization has most often been carried out with single s'age furnaces, but multiple stages have also been used. Elongation and restraint against shrinkage have been employed, generally in one stage. Although the material used is sometimes in fabric form, the typical process utilizes large tows, with multiple filaments being distributed across a flat plane so that longitudinal tension can be exerted and the gases have substantially equal access to the fibers.

Illustrative of variations in the above noted procedures for producing carbon fibers are U.S. Pat. Nos. 3,652,22 3,663,173 and 3,716,331, which deal with the use of multiple carbonization stages and the use of tension during carbonization, but all are concerned with partially carbonized cellulosic precursors. Restraint against shrinkage is used with polyacrylonitrile fibers during carbonization in U.S. Pat. Nos. 3,698,865 and 3,412,062. In U.S. Pat. No. 4,100,004 a two stage oxygenation procedure is disclosed together with a two stage carbonizing procedure, employing temperatures in the range of 600° to 700° C. in the first carbonizing furnace and a temperature in the range of 1050° to 1600° C. in the second furnace.

A Japanese publication J5-4147-222 discloses a process for producing carbon fiber with improved tensile strength and modulus by first passing acrylic fibers through an oxidizing oven at 230°-250° C. to effect 10% shrinkage. The flameproofed or stabilized fibers are then preliminarily carbonized at a temperature from 300° to 800° C., particularly from 400° to 600° C. while being subjected to a high stretch up to 25%, in a nitrogen gas atmosphere. The elongated partially carbonized fibers thus obtained are finally or completely carbonized at elevated temperature of 1300° C. with 3% shrinkage. This is a specific example of the multiple stage carbonization techniques mentioned above. The use of multiple stages slows the outgassing or decomposition process somewhat, reducing defects in the carbon fibers.

More recently in the development of this art, workers have confronted the secondary but important problems arising from the release of volatile components and tars in the carbonization environment. It has been recognized that redeposited tars and other matter accumulate and restrict the flow of gases, and further that contact of this matter with the fibers damages or weakens them. Yields are not only decreased but the entire process is unduly sensitive to operating conditions. Consequently, as shown by various publications, different expedients have been proposed for alleviation of problems arising from the products of decomposition. Examples of these approaches are found in U.S. Pat. No. 3,508,871 (using a solvent to remove tarry materials), Japan Kokai 7740622 (two stage carbonization), German Offen. 2133887 (fast carbonization using electric oven and volatiles removal), U.S. Pat. No. 4,020,273 (upward flow of gas in opposition to downward flow of fibers) and U.S. Pat. No. 4,073,870 (countercurrent flow of gas in a two section furnace).

SUMMARY OF THE INVENTION

In accordance with the invention, applicant has ascertained that interrelationships exist between the dynamic, chemical and dynamic processes occurring during carbonization and that a precarbonization procedure under controlled conditions is to be integrated with a final, higher temperature carbonization step. In precarbonization, substantial gas evolution and rapid mechanical change are countered by both sweeping the fibers with preheated inert gas in a selected volume ratio and applying a significant percentage of stretch. The temperature profile in the precarbonization volume, and the residence time of the fibers therein, are chosen to be within controlled limits, with both entry and exit regions being at relatively low temperatures. Volumes of hot inert gas passing across the fibers in at least one specific region carry off decomposition products, such as volatiles and tars generated during precarbonization, to exhaust outlets which are spaced and disposed such that redeposition on the fibers does not occur. The precarbonization step is thus carried out while maintaining products of decomposition above a redeposition temperature until they are out of communication with the fibers. A predetermined amount of heated gas volume per unit weight of fiber provides uniform rapid heating and entrainment of 90% or more of the tars and volatiles. The subsequent carbonization is effected using some tension, but substantially less than during precarbonization.

It has been found particularly that carrying out the precarbonization of the oxidized and stabilized carbon fibers at temperatures ranging from about 350° to 620° C., while passing inert gas such as nitrogen preheated to a temperature of at least about 400° C., preferably ranging from about 400° to about 450° C. at a rate of about 10 to 17 liters of gas per gram of carbon fibers, across the fibers, and while concurrently stretching the fibers from 5% to 20% in comparison to the length of the stabilized fibers, and by thereafter carbonizing the previously heated stabilized fibers at a temperature ranging from about 1100° to about 1250° C., while limiting shrinkage (negative stretch) to the range of −2.5% to −5.0%, results in removal of in excess of 90% of the tars during precarbonization, avoids redeposition of such tars on the fibers, and produces high tensile carbon fibers, at efficient rates. Further this procedure enables an increase in the speed of passage of the fibers through the earlier oxidizing zone as well as through both the precarbonizing and carbonizing zones.

Methods in accordance with the invention for producing carbon fibers having high tensile strength from precursor fibers comprise the steps of:

(a) heating the fibers under oxidizing conditions at a temperature ranging from about 200° to about 300° C. while elongating the fibers in a range of 10%-20% relative to their original length to provide stabilized fibers;

(b) heating the stabilized fibers in the range of about 350° to about 620° C. while passing heated inert gas at a temperature of at least about 400° C. across continuously advancing fibers, the gas flow being at a rate of between about 10 and about 17 liters of gas per gram of fibers, the gas flows being directed tangential to the fibers but toward exhaust outlets intermediate the ends of the heating zone to thereby prevent deposition of tars on the fibers, while concurrently stretching the fibers from about 5% to about 20% in comparison to the length of the stabilized fibers, thereby partially carbonizing said fibers;

(c) establishing a temperature profile through the use of auxiliary heating that peaks in an intermediate region substantially coextensive with the exhaust outlets and is at low levels in the fiber entry and exit regions; and (d) thereafter carbonizing the previously heated stabilized and precarbonized fibers at a temperature in the range of about 800° to about 1250° C., while limiting shrinkage (negative stretch) to the range of about −2.5% to −5.0%.

The inventive concepts also include novel furnace arrangements in which fibers are precarbonized by passage as a distributed tow through a vertical furnace structure having a group of differentially driven tension rollers at each end. A gas afterburner-preheater combination burns products of decomposition from the carbonization furnace while preheating inert gas to a desired level for input to the precarbonizing furnace. The input hot gas flows are injected adjacent a lower region of the furnace, tangential to the plane of the fibers on opposite sides thereof. Exhaust flows are taken from each side of the furnace at regions in which the internal temperature is still well above redeposition temperature. It is advantageous to confine the tow of precarbonizing fibers within a muffle and to raise the fibers to peak temperature levels by electrical elements outside the muffle. End seal systems incorporating injection of cold inert gas and water cooled seals insure against inflow of oxygen and aid in maintaining the desired temperature profile in the furnace.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
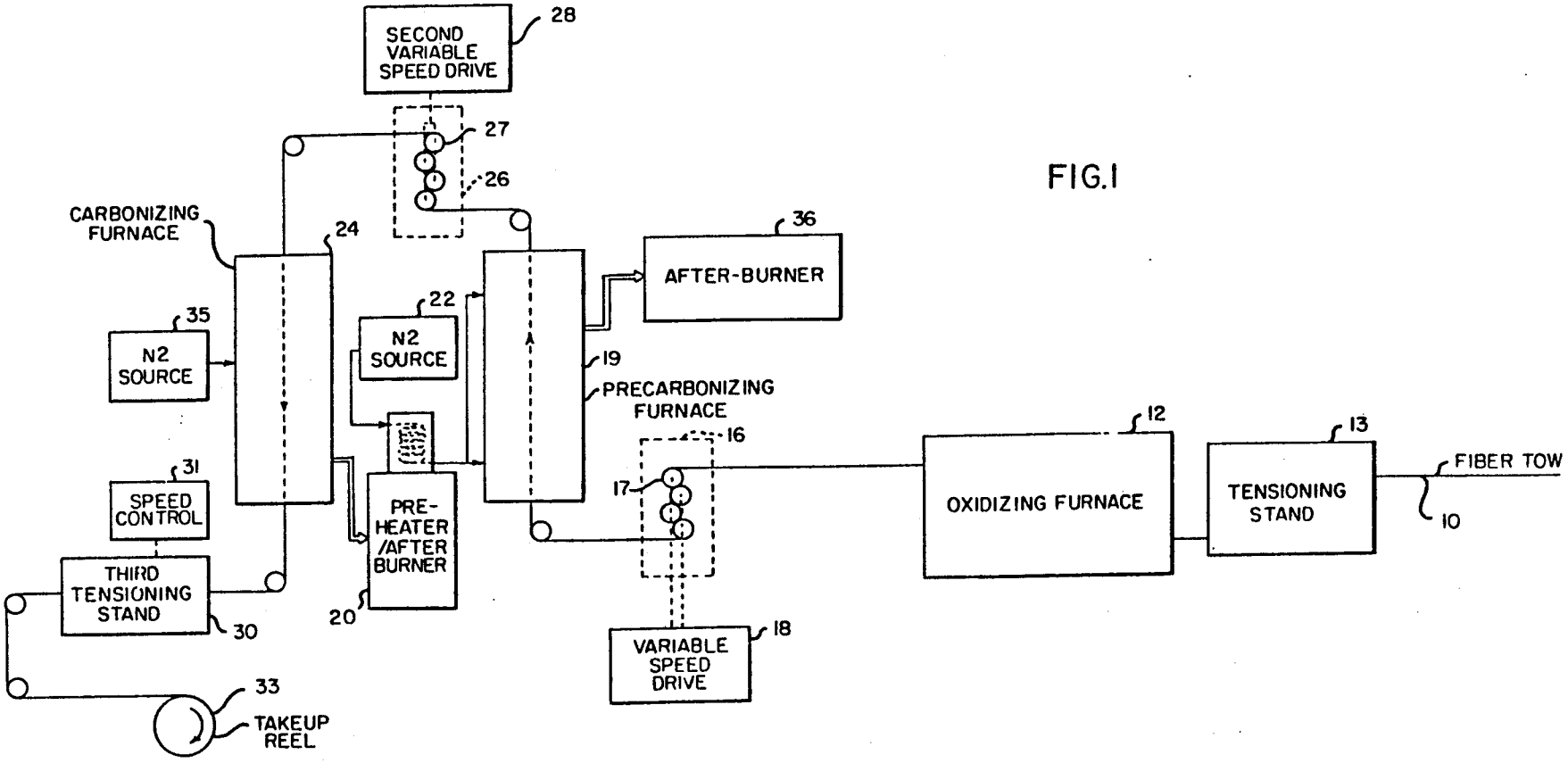
FIG. 1 is a flow sheet of one embodiment of a method of making carbon fibers according to the invention.

Precursor fibers for use in methods and systems in accordance with the invention can be any carbon-containing fiber which is suitable for carbonizing, including polyacrylonitrile and copolymers, such as, for example, copolymers of acrylonitrile and other compatible monomers, e.g. methyl methacrylate or vinyl acetate. The preferred fibers according to the present invention are polyacrylonitrile (PAN) fibers, although it should be noted that other fibers which are oxidized or stabilized, then carbonized with controlled tension, may be used to particular advantage.

In methods in accordance with the invention, the precursor, e.g. PAN, fibers are converted to carbon fibers by first passing the precursor fibers through an oxidation furnace or zone to effect complete internal chemical transformation to stabilized fibers, as well known in the art. The precursor fibers, which can be in the form of a multi-filament sheet, tow or web, are heated in contact with an oxidizing medium such as oxygen, or oxygen-containing gases including air. Chemical oxidation processes are also known and may alternatively be used. The precursor fibers are heated in the oxidation furnace to a temperature ranging from 220° to 300° C., preferably about 240° to about 280° C., at which temperatures the cross-linking reaction essential to stabilization can be completed. During oxidation, the precursor fibers are heated gradually to the specific temperature range, and are maintained in the range for a relatively lengthy period, e.g. from about 40 to about 90 minutes. Concurrently, relatively high stretch of the fibers is used in order to preserve molecular orientation and crystalline microstructure in order to achieve suitable levels of tensile strength and modulus of elasticity in the finally processed fiber. Elongation or stretching of the fibers in an amount in the range of about 10% to 15% relative to their original length is usually employed. In the oxidation reaction, exothermic heat is carried away by circulation of substantial quantities of air within the furnace and about the entrained fibers, so as to properly dissipate the exothermic heat produced and prevent catastrophic failure. The oxidation furnace can be a single zone but is preferably in the form of multiple zones, up to four, of successively higher temperatures.

Line speeds of the fibers or fiber web through the oxidation furnace can vary but are typically in the range of 3.1 feet per minute. The oxidation densities can range from 1.33 to 1.42, for different line speeds. It has been found that line speeds of the fibers in the oxidation furnace can be increased because of the better performance due to the carbonizing procedure set forth in greater detail below. Such line speeds can apply to various fiber materials, webs and tows, although it is preferred to use a planar distribution of 3K (3000 ends), 6K, 10K or 12K tows (depending on the production rate desired).

The oxidized fibers exiting the oxidation furnace are then subjected to two different stages of carbonization, either immediately on a continuous flow basis or after a delay. The two separate stages employ different temperature levels, different heating conditions, different mechanical handling factors and different gas dynamics. A first furnace or heating zone may be regarded as a precarbonizing zone or stage in which the tow or web of fibers is heated, while stretching, at a temperature ranging from about 350° to 620° C., preferably in the 400° to 600° C. range. The heating in the precarbonizing zone is initially effected by injecting substantial volumes of inert gases, preferably nitrogen, preheated to a temperature range well above the highest level used during oxidation. The gases enter from about 400° to about 450° C., e.g. about 400° to 420° C., and impinge on and along the fibers within the interior of the furnace to carry away volatile gases and tars as they are emitted from the heated fibers. Additional thermal energy is added by means of heating elements in the intermediate region of the precarbonizing furnace so as to increase the temperature to a higher maximum, e.g. the preferred maximum of 600° C. in the midregion of the precarbonizing zone. Positive pressure and insulated flow paths are maintained for the outgassed products from the fibers, to insure an oxygen-free atmosphere and prevent contact with and recondensation on cold surfaces. By sweeping the fibers with hot inert gas flows, and maintaining the residual gases at a relatively high temperature, the tars which are carried away by the inert gases do not fall back or redeposit on the fibers or collect around the colder inlet or exit regions of the precarbonizing zone.

It has been found that best results, in terms of a high tensile strength carbon fiber, are obtained by employing from 10 to 17, preferably about 13, liters of inert gas or nitrogen, per gram of carbon fiber in the precarbonizing zone. In this precarbonization step the fibers undergo increasing temperature rise from the relatively low temperature entry region to a maximum value and then return to a lower temperature at the exit region, giving a temperature profile in the shape of a rounded peak. Maximum offgassing and loss of weight occurs in this step, as contrasted to later heating to higher temperature, and the fibers undergo a pronounced change in physical and chemical character. To preserve molecular orientation through this precarbonization phase, heating of the fibers is carried out while concurrently stretching the fibers from 5% to 20% in comparison to the length of the oxidized fibers, preferably in the range of 6% to 8%. It has been found that if the dilution factor, i.e. the ratio of the number of liters of inert gas or nitrogen, per gram of carbon fiber is too low, damage due to tar deposition on the fibers occurs. The average ultimate tensile strength of the fibers deteriorates, despite maintenance of other conditions in correspondence to the degree of tar concentration on the fibers. It has been found that significant positive stretching is an important parameter, in conjunction with the above noted dilution factor for flow of heated nitrogen in the precarbonizing zone, for production of uniform carbon fibers having high ultimate tensile strength. Products given off during heating in this stage introduce a tendency to shrink, but the fibers are compliant and have a degree of plasticity that permits substantial stretching, with beneficial results in improving internal orientation and alignment. Thus stretching in this region can be regarded as being most effective at the peak temperature subregion, and as acting in a manner to impart rather than preserve physical properties.

Residence time of the fibers in the precarbonizing zone can range from about 5 to about 20 minutes, usually from about 5 to about 10 minutes. The exhaust from the precarbonization furnace consists of a major proportion of nitrogen and minor amounts of off-gases consisting of carbon monoxide, with trace amounts of acrylonitrile, cyanide and hydrocynaic acid gases. In an example of such exhaust from a precarbonization furnace, such gases consisted of 97.1% nitrogen and 2.9% total off-gassed products from the fibers.

The precarbonized and stabilized fibers, in the form of a sheet or a tow, are then subjected to a final carbonizing stage taking place at a temperature in excess of 800° C. up to a final temperature range of about 1100° to about 1600° C., depending upon the balance of tensile strength vs. modulus of elasticity that is desired. Final temperatures of up to about 1250° . C. are used to improve the tensile strength of the fibers. In a preferred example of a carbonizing zone, the multi-filament sheet, tow or web of fibers is heated in a first stage to a temperature ranging from about 850° to about 900° C., then in a second stage up to about 1100° C. and in a final stage to a temperature in the range from about 1100° to about 1250° C., preferably about 1100° to about 1200° C., which provides the major portion of heat treatment in the carbonizing zone. Residence time in the carbonizing zone can range from about 5 to about 10 minutes.

In the final carbonizing zone the treated fibers are passed through the zone while limiting shrinkage (negative stretch) to the range of −2.5% to −5.0% by maintaining suitable tension on the fibers traversing the zone. This has direct relation to the stretch conditions used during precarbonization. Again, a significant shrinkage would take place during carbonization as the final non-carbonaceous compounds are driven off. However, the fibers in this phase are substantially stronger (increasingly so as temperature increases) and the tension required to stretch them would approach a breaking stress. Consequently, restraint against shrinkage to the stated percentages acts to preserve the orientation and alignment previously established.

Referring now to FIG. 1 of the drawings, a continuous processing system is depicted that serially processes precursor PAN tow 10 into high tensile carbon fibers. The system is shown only schematically in FIG. 1 because details that bear upon apparatus in accordance with the invention are shown more explicitly in FIGS. 2–4. The precursor tow 10 is distributed into a planar sheet and passed through an oxidizing oven 12 from an initial variable speed tensioning stand 13 at the entrance ends thereof. The oxidizing oven 12 may include multiple stages and a number of roller sets disposed in relation to the stages so as to impose different controllable stretches in the fibers passing therethrough, by using high wrap angles about the rollers and differential drive velocities. Numerous alternative designs of oxidizing ovens and tension control systems are well known to those skilled in the art, and thus these need not be described in detail. However, by maintaining the temperature in different zones of the oxidizing oven 12 in increasing ranges from 240° C. up to about 280° C., employing a residence time of 60 to 90 minutes and stretching the fibers from 10–15% net relative to their original lengths, complete oxidation and internal cross-linking are obtained and stabilized fibers are provided that are suitable for subsequent carbonization. The length of the oven (and the number of multiple passes used) provide an average fiber advance rate of about 3.1 feet per minute, which is matched in subsequent processing steps in a continuous system.

From the oxidizing oven 12 the fibers pass to another tensioning stand 16, comprising a vertical stand of rollers 17 through which the sheet of fibers is wound in serpentine fashion. This stand 16 may be regarded as the first stand of the carbonizing portion of the system. It is often convenient to separate the process, as by stabilizing the fibers first and then carbonizing after a substantial delay rather than in one continuous sequence. A variable speed drive 18 coupled to the rollers 17 feeds the fibers at a selected rate into the bottom of a vertical precarbonizing furnace 19, which receives preheated inert gas from an afterburner/preheater 20 coupled to receive cold inert gas from a nitrogen source 22 and off-gassed product from an adjacent carbonizing furnace 24. The fibers pass vertically through the precarbonizing furnace 19 to a second tensioning stand 26 comprising a stand of rollers 27 controlled by a second variable speed drive 28. From the second tensioning stand 26 the sheet of fibers moves downwardly through the vertical carbonizing furnace 24 to a third tensioning stand 30 operated by a speed control 31, after which the fibers are wound onto a takeup reel 33. Nitrogen gas is injected into the carbonizing furnace from a source 35, the needed high internal temperature being attained by electrically energized susceptor elements (not shown). Off-gassed products are diverted to the afterburner/-preheater 20, and an afterburner 36 is also used to receive and neutralize the off-gassed residues from the precarbonization furnace 19. Both afterburners 20, 36 receive air and fuel to insure complete combustion.

The tow 10 of oxidized and stabilized fibers is passed through the precarbonizing furnace 19 and carbonizing furnace 24 under the previously described conditions of temperature, gas flow and applied tension according to the features of the invention in order to produce carbon fibers, particularly from PAN precursor fibers, with improved physical properties, including high tensile strength, particularly by extracting volatile products and tars so that there is no redeposition on the fibers.

Figure 2:
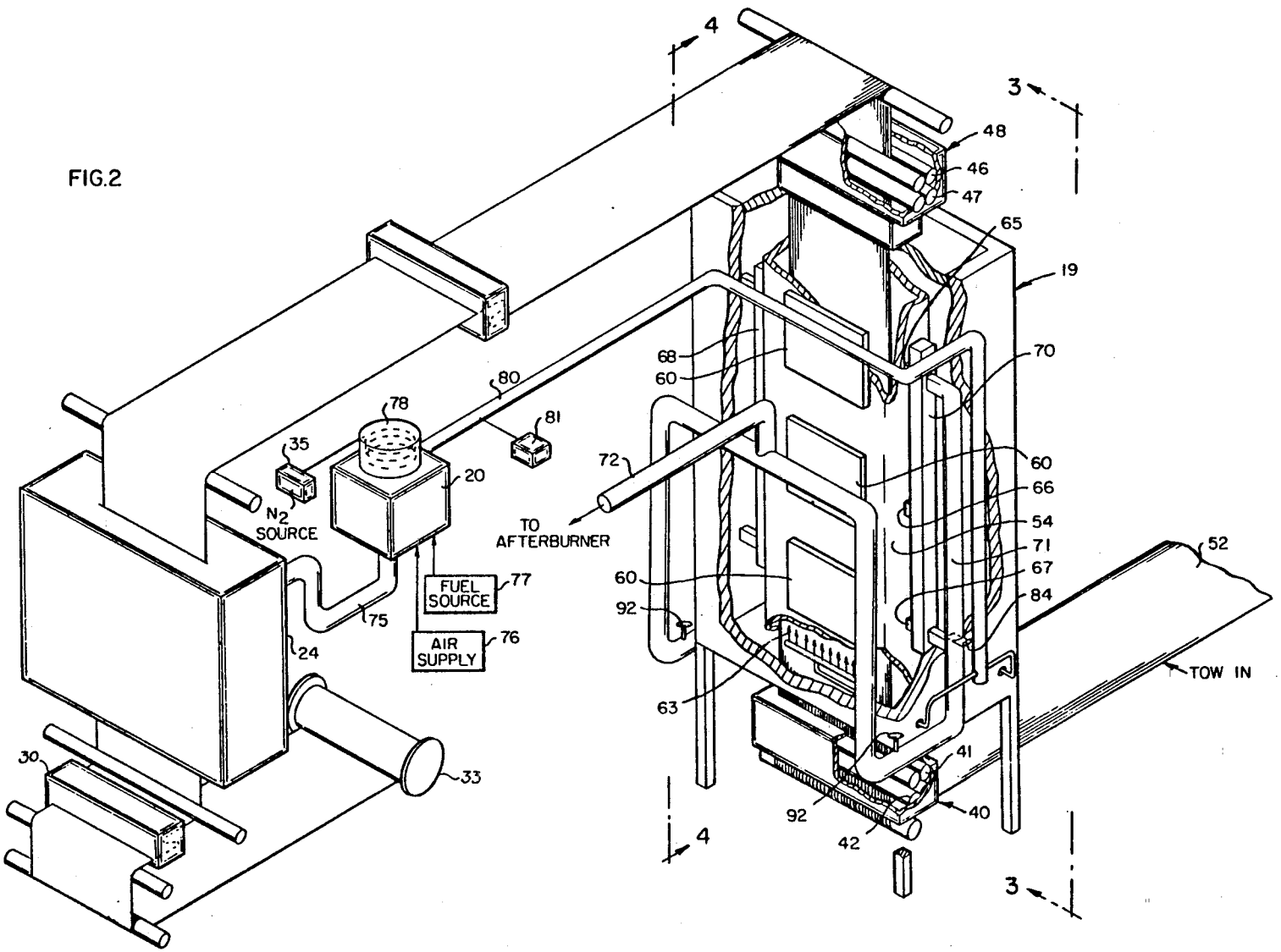
FIG. 2 is a simplified perspective view of a precarbonizing furnace and carbonizing furnace system in accordance with the invention process.
Figure 3:
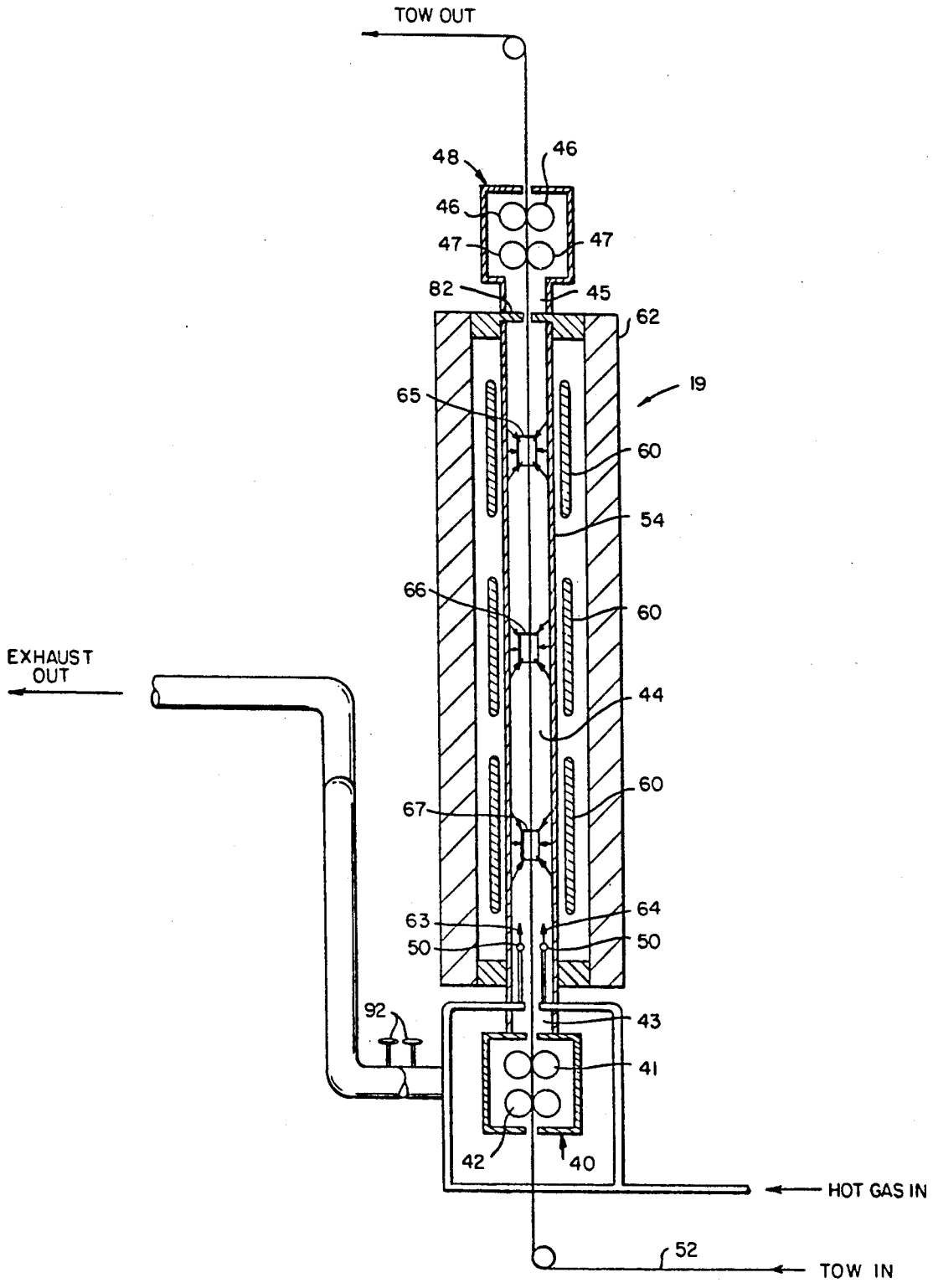
FIG. 3 is a side sectional view of the precarbonizing furnace.
Figure 4:
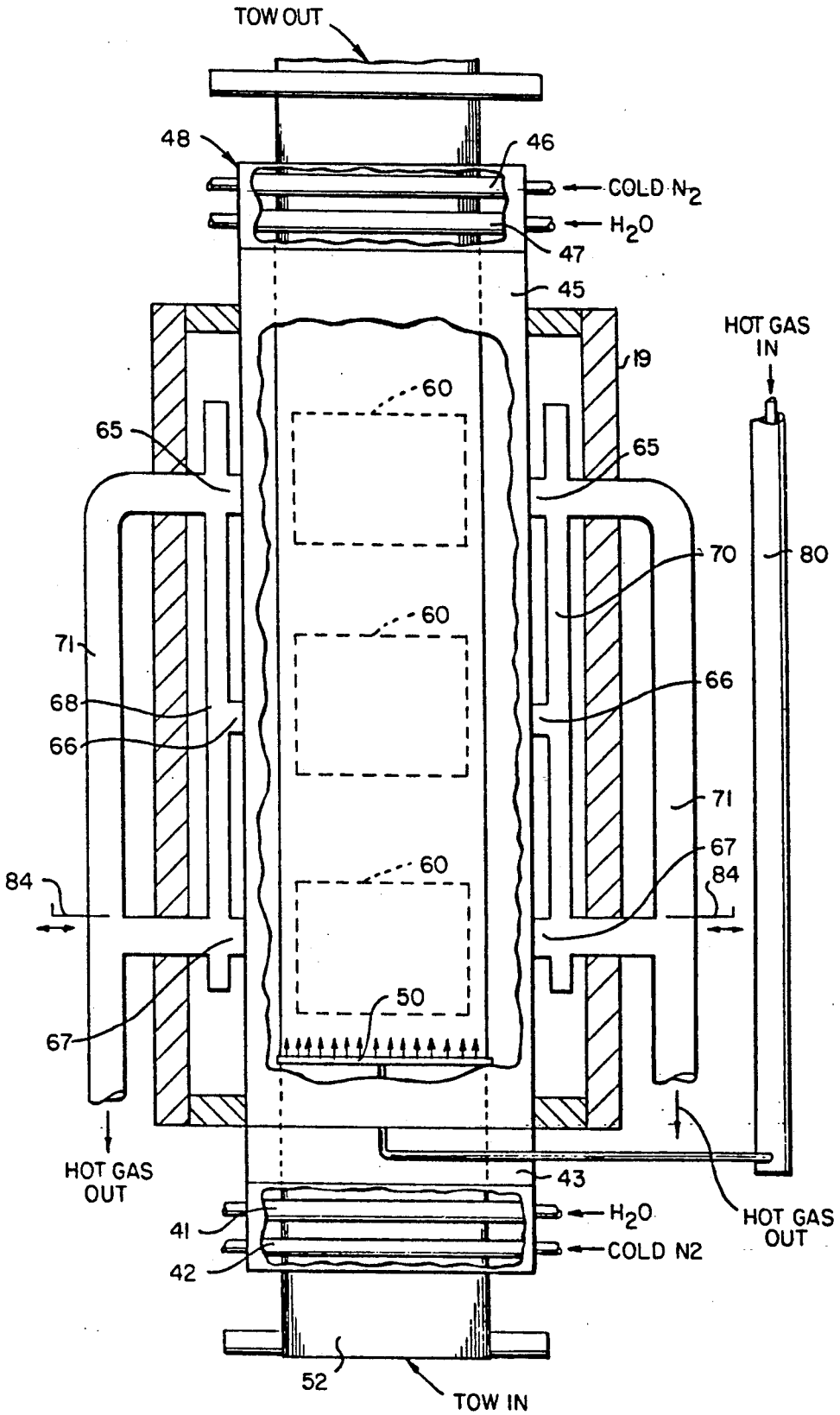
FIG. 4 is a front sectional view of the precarbonizing furnace.

FIGS. 2–4 of the drawings illustrate an example of one arrangement of precarbonizing furnace 19 and associated systems for treating the oxidized and stabilized fibers exiting the oxidizing oven 12 (FIG. 1). The tow of stabilized fibers leaving the oxidizing unit is guided around a roller 38 after the initial tensioning rollers 17 (FIG. 1 only) and enters the precarbonizing furnace 19 upwardly through a bottom gas seal assembly 40. The precarbonizing furnace may be vertically or horizontally disposed, relative to the path of the tow. A vertical path is employed in this example because it enables the tow to be passed directly across to an adjacent carbonizing furnace for downward passage therethrough to a final takeup reel. However, because of the fact that the heated gases seek to rise along the fibers, avoidance of redeposition of matter on the fibers is easier with a horizontal path and so in this sense the vertical furnace disclosed represents the solution to a more difficult problem. In the assembly 40 the fibers pass first between a pair of sparger rolls 41 which inject cold inert gas (nitrogen) and then between closely spaced water cooled tubes 42. The cold nitrogen maintains a positive internal pressure relative to ambient to insure against substantial ingress of air and oxygen about the tow of fibers as it enters. A low temperature level in the inlet region is assured by the presence of the water cooled tubes 42 in the assembly 40. The sheet of fibers then passes upwardly through a lower constricted extension or passage 43, through the central region 44 of the furnace 19, then through an upper constricted extension or passage 45 adjacent the upper end of the furnace, and exits between water cooled tubes 46 and then cold gas spargers 47 of a top seal assembly 48.

As the web of fibers enters the lower part of the central region 44 of the furnace 19, hot nitrogen, previously heated to a temperature, e.g. of about 400° C., is injected upwardly into the furnace through a pair of horizontally positioned parallel sparger bars 50. These spargers 50 are disposed closely adjacent each other laterally across the bottom portion of the furnace and on opposite sides of the distributed tow of fibers 52 passing through the furnace. Rows of orifices in the spargers 50 inject hot gas tangentially to the tow 52 and upwardly toward the furnace center along an internal metal muffle 54 which fits within the periphery of the furnace about the tow. As previously noted, the nitrogen is injected into the interior of the furnace 19 employing 10 to 17 liters of nitrogen per gram of carbon fiber.

The interior space or central heating region 44 of the furnace 19 is bounded by the muffle enclosure 54 (FIG. 3). Between the outer walls of the muffle 54 and the inner wall of the furnace 19 are positioned several vertically spaced conventional electrical heating elements 60 such as Nichrome band heaters, shown only in idealized form for simplicity. These heating elements 60 in conjunction with the hot nitrogen injected into the interior of the furnace 19 raise the temperature of the fiber tow 52 to about 600° C. in the mid-region of the furnace 19 as the tow 52 passes upwardly. The furnace 19 also has insulated outer walls 62 (FIG. 3) which can be formed of insulating material such as refractory bricks or tiles.

The hot nitrogen gases from the spargers 50 initially sweep upwardly as shown by the arrows 63 and 64 in FIGS. 2 and 3, and impinge tangentially on the tow 52 passing through the central interior of the muffle 54. Off-gassed products from the oxidized fibers that are entrained with the gas flows include carbon monoxide and can also include methane and nitrile substituted alkanes and alkenes, and tars. The large volume of hot nitrogen gases sweeps the off-gassed mixture and tars in turbulent flow upwardly in expanding fashion. While still at sufficiently high temperature to be in a mobile state and out of communication with the fibers, the products of decomposition exit laterally through spaced apart ports 65, 66, 67 on opposite sides of the muffle 54 and adjacent the edges of the tow 52. The exit ports 65, 66, 67 are coextensive with the length of furnace 19 that is heated by the elements 60, thus assuring that both the tow and gases are at high temperature in the region from which the hot gases are extracted. From the exit ports 65, 66, 67 the gases move into side manifolds 68, 70 and then into oppositely disposed insulated manifolds 71 at the bottom of the furnace 19. They are then combined to flow in a single insulated conduit 72. The off-gassed volatiles and tars are then conducted via conduit 72 to the afterburner 36 system of FIG. 1.

At the carbonizing furnace 24 entrained products of carbonization at temperatures in excess of approximately 400° C. are coupled via a conduit 75 to enter a reaction chamber in the preheater/afterburner 20. An air supply 76 and gaseous fuel source 77 are coupled into the reaction chamber to thoroughly burn the off-gassed products. At the upper end of the preheater/afterburner 20 cold nitrogen from a supply source 35 is passed into a heat exchanger 78 through which the products of combustion pass in thermal exchange relation. The thus heated input nitrogen, heated to the above noted temperature of about 400° C., is supplied via insulated conduits 80 from the afterburner heat exchanger 78 to the hot nitrogen spargers 50. Regulation or adjustment of the relative volume of cold nitrogen supplied subsequent to the heat exchanger 78 from a separate source 81 enables regulation of the temperature of the heated incoming gas into the furnace 19.

A baffle 82 (FIG. 3) is provided in the upper portion of the furnace above the muffle 54, to constrict and prevent a substantial part of the off-gassing in the central region of the furnace 19 from going upward to the top zone and eventually toward the upper seal assembly 48 so as to redeposit on the fiber tow 52. The separate insulated piping ducts 71 efficiently remove the off-gassed products from the side manifolds 68, 70 respectively by the use of two junctions, one adjacent each end of the associated side manifold 68, 70. Control of the relative rate of exhaustion of gases from these upper and lower junctions is effected by externally accessible dampers 84 (FIGS. 2 and 4) in the ducts 71 at locations just prior to where the flows from the junctions are united. The exhaustion of gases can thus be balanced between upper and lower ends of the furnace 19 so as to aid in maintaining a selected temperature profile. Constricted furnace extension volumes 43, 45 at each of the lower and upper ends, respectively, limit the capability of products of decomposition from reaching the bottom and top seal assemblies 40, 48 and condensing thereon. The upper extension 45 also aids in cooling down the fiber tow 52 sufficiently before it exits the furnace 19 so that it does not react with the oxygen in the air. The degree of cooling is such that off-gassing from the fiber material terminates before it reaches the top seal assembly 48, thus preventing tar condensation in such seal.

Valves 92 are provided in the opposite side ducts 71 so that the flow of exhaust gases can be balanced between the opposite sides of the furnace 19. This adjustment avoids the problem of having one side of the fiber tow 52 become significantly weaker than the other side due to a high concentration of gaseous tars on one side or the other of the fiber material. Flows of off-gases are approximately determined, and accordingly may be adjusted using the dampers 84 and valves 92, by the temperature differential of the gases in the ducts 71.

Figure 5:
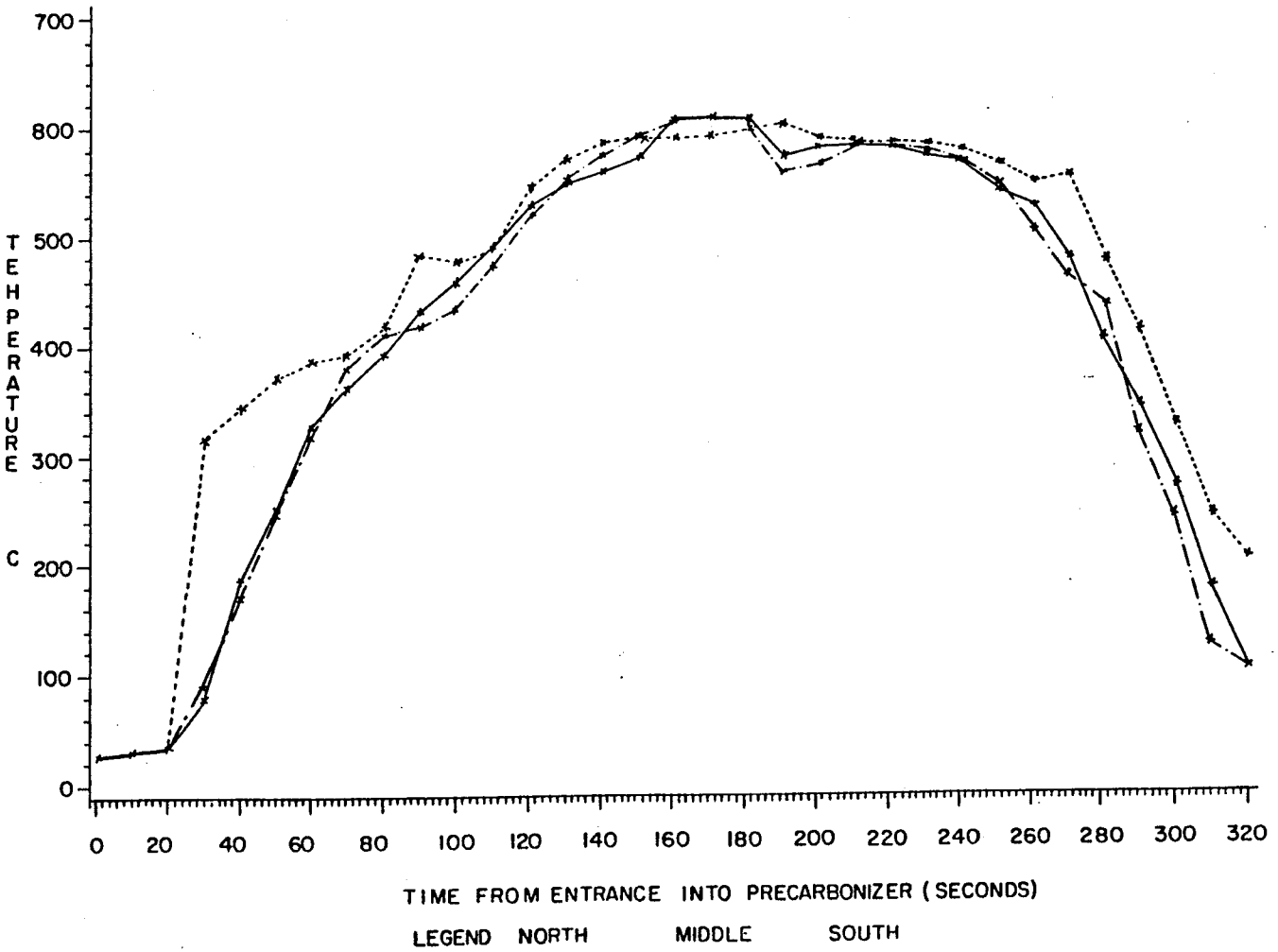
FIG. 5 is a temperature profile of temperature variations encountered by a stabilized polyacrylonitrile fiber passing through the precarbonizing furnace.

Thus, as may be seen graphically from the temperature profile of FIG. 5, in relation to the vertical furnace 19 of FIGS. 2–4, controlled temperature conditions confine the dynamic decomposition process essentially to the midregion of the furnace. The temperature of the previously oxidized fiber tow 52 is initially low at the entry region, where cold $N_2$ from the spargers 42 prevents ingress from the ambient air and where the adjacent water cooled tubes 41 and the extension section 45 provide thermal isolation from the furnace 19 interior. Once the tow section enters the furnace 19 a short distance, the temperature of the fibers themselves rises rapidly, at the outset principally because of the hot gases impinging on each side from the spargers 50. The gases, including products of decomposition, tend to upwell within the muffle 54, but are blocked from free vertical movement because of the high flow impedance presented by the baffle 82 at the upper end, and the adjacent narrow extension 45. Instead, the flows encounter much less resistance to lateral movement and thus quickly begin to move to the lowermost side exit ports 67. Actual fiber temperature plotted in FIG. 5 is thus seen to gradually increase from about ambient temperature up to about 600° C. in the middle zone of the furnace. In this region the supplemental heaters 60 are most effective. The greatest activity in emission of volatiles and tars from the heater carbon fibers occurs in the range up to about 500° C., which can be seen in FIG. 5 to occur in about the lower third of the furnace. The products of decomposition in this region are additionally swept away toward the middle and upper side exit ports 66, 65 respectively by the nitrogen purge gas. After the peak of about 600°–620° C. the temperature of the tow 52 quite rapidly decreases as it approaches the top of the furnace 19 to a level which is close to ambient. This cooling within the furnace occurs because of the efficient withdrawal of hot gases, and the cool structure coupled to the upper end of the furnace 19, and may be aided by using lower wattage to drive the upper heater 60 in comparison to the lower ones. When the fiber tow exits the precarbonizing furnace 19 into the upper extension 45 and then into the upper seal assembly 48 the temperature is well below the decomposition temperature. Furthermore, because the hot gases were drawn off previously, this cold exit region is effectively isolated from the hot volatiles and tars. Because such gaseous and decomposed flow components are drawn off quickly and allowed to cool very little, the tendency to collect or redeposit on the fibers is minimized. Consequently the partially carbonized tow 52 leaving the furnace 19 is essentially free of tar deposition and imperfections and is substantially uniform throughout.

The usage of substantial amounts of hot inert gas in this manner provides a number of material advantages. In being heated above 400° C. the inert gas has a substantially higher effective volume than it would otherwise have when injected. Moreover, the impinging gases both facilitate the needed initial temperature rise and create movement away from the fibers in the products of decomposition with which they combine. Of perhaps equal importance, the hot nitrogen prevents the condensation of tar inside the furnace, thus avoiding dripping of these tars back onto the tow or onto the cooler end seal assemblies, particularly in the lower part of the furnace. Separate precarbonization combined with stretch in a specified range thus preconditions the fibers in a most advantageous manner for subsequent completion of carbonization.

The precarbonized stabilized multi-filament tow 52 is then conducted as best seen in FIGS. 1 and 2 over the second tensioning stand 26 before entering the carbonizing furnace 24 downwardly from the top. As the precarbonized tow 52 passes downwardly through the carbonizing furnace 24, it encounters first an initial zone which raises the temperature of the fibers to between about 850° and 900° C. The second or middle zone 88 raises the temperature of the fibers up to about 1100° C., and thereafter the tow passes through the lowermost third zone 90, which raises the temperature of the fibers to a maximum of between about 1200° and 1250° C. As noted above the final temperature level is determined in accordance with the tensile and modulus properties desired in the fibers. The carbonizing furnace 24 is of conventional type, the successive zones being heated by suitable conventional electrical elements such as graphite susceptors, although inductive or resistive elements may alternatively be used.

During passage through the carbonizing furnace 24, the fibers are restrained from shrinkage beyond a predetermined amount by a velocity differential between the second tensioning stand 26 and the third tensioning stand 30. Shrinkage of the heated and stabilized fibers is limited to the range of −2.5% to −5.0% (negative stretch), in comparison to the length of the precarbonized or stabilized fibers exiting the precarbonizing furnace 19.

The residence time of the tow of fibers 52 in the carbonizing furnace 24 can range from about 4 to about 10 minutes. The carbonized fibers exiting the carbonizing furnace 24 are passed from the last tensioning stand 30 onto the takeup reel 33.

The carbon fibers treated according to the invention process, especially as a result of the precarbonizing treatment under the conditions noted and described above, are free of any tar deposits, and are of high tensile strength, low thermal conductivity, have very high electrical resistance and are hydrophobic. Affirmative and substantial stretch in the precarbonization zone, together with restraint from shrinkage in the carbonization zone derive greatest benefit in physical properties when there is hot gas heating in the initial, most critical decomposition zone. Because tars are not dispersed or deposited on the fibers in the precarbonization zone, an increase in line speed of the fibers is enabled through all of the treating zones including the oxidation, precarbonization and carbonization zones. Other advantages of the invention process include making longer continuous runs with substantially reduced shutdown and producing improved carbon fibers with improved physical properties, for example fibers having in excess of 600,000 psi tensile strength and greater than 1.5% strain to failure (expressed as ratio of tensile to modulus). The process also enables production of improved lower modulus carbon fibers having less than 30 msi modulus with lower thermal and electrical conductivity for special aerospace applications, while also allowing production at lower final temperatures than heretofore of higher modulus, greater than 35 msi, fibers.

The following are examples of practice of the invention:

EXAMPLE I

Using 500 ends of 6K (6,000 filaments) tow having 600 ends, of Mitsubishi polyacrylonitrile, the tow was passed through an oxidizer having four temperature stages of 235°, 245°, 246° and 247° C., respectively, while the fibers were elongated or stretched about 12% relative to the original length of the fibers. The tow was passed through the oxidizing oven at a speed of about 3.1 feet per minute and the fibers were oxidized to an oxidation density of about 1.37. The residence time in the oxidizing oven was about 80 minutes.

The resulting oxidized fiber tow was then passed through a precarbonization furnace while the fibers were being heated to a temperature in a range of about 400° to about 600° C. while impinging hot nitrogen gases heating the fibers to a temperature of 400° C. The flow of nitrogen was at a rate or dilution factor of 13 liters of nitrogen per gram of carbon fiber. The desired flow of nitrogen into the precarbonizer corresponded to 550 scfh for each bottom sparger in the precarbonizing furnace. During passage through the precarbonizing furnace, the tow was stretched about 7.5% relative to the original length of the precursor fibers. Residence time of the tow in the precarbonizer was about seven minutes.

The previously heated and precarbonized tow was then carbonized in a carbonizing furnace by passage through three zones therein at a temperature of about 800° to 900° C. in the first zone, up to about 1100° C. in the second zone and up to about 1200° to 1250° C. in the third zone, while maintaining a shrinkage (negative stretch) of the tow of about −4.5%.

The resulting tow of carbon fibers had a high tensile strength of about 573,000 psi and modulus of about 35,000,000 psi.

EXAMPLE II

Using a 3K polyacrylonitrile tow with 600 ends, such precursor fibers were subjected to oxidizing, precarbonizing and carbonization essentially under the conditions of Example I, the precarbonization being carried out in a precarbonizer furnace having a length of 200 inches.

Over the 200 inches of the furnace, as seen in FIG. 5, the temperature is relatively at ambient for more than the first 10 inches then rises substantially linearly up to about 60 inches, when it is approximately 420° to 480° C., then forms a rounded top with values of approximately 580° C. at 80 inches, a peak of approximately 600° C. at 100 inches, lowering down to a value of approximately 550° C. at 140 inches and then a substantially linear drop in temperature to approximately 190 inches where the temperature is approximately 100° C. and then levels off slightly to a few degrees less at the outlet.

The exhaust from the precarbonization furnace was measured at 97.1% $N_2$ and 2.9% total off-gassing. Gas analysis showed that 0.122% of this was gases, the great majority of which were carbon monoxide, with virtually trace amounts of acrylonitrile, cyanide and hydrocyanic acid gases. Thus, the conclusion was that tars and other constituents constituted 2.78% of the off-gassed products.

EXAMPLE III

The procedure of Example I was carried out except that the amount of hot nitrogen purge gas was reduced below 10 liters per gram of carbon fiber, down to a rate of 7.2 liters per gram of carbon. The resulting carbon fibers contained local tar deposits and the tensile strength of the resulting fibers was substantially reduced to about 431,000 psi.

EXAMPLE IV

Using Sumitomo 12K polyacrylonitrile tow, the tow was subjected to (a) oxidizing and carbonizing, employing procedure similar to Example I, but without any precarbonizing, (b) oxidizing, precarbonizing and carbonizing as in Example I, but without the use of hot nitrogen purge gas during precarbonizing, and (c) the procedure of Example I employing precarbonizing with hot nitrogen in the precarbonizer as in Example I.

Running a total of 0.9 meg filaments without precarbonizing, according to procedure (a) above, the run had to be stopped every 12 to 24 hours to clean the tars and soot at the furnace seals and the exhaust system.

Running a total of 3.0 meg filaments with precarbonization with hot nitrogen according to procedure (c) above, the maximum days of running time was not determined because the precursor fibers were used up before clean up was necessary. This increased productivity and also reduced waste significantly.

The ultimate tensile strength of the fibers produced by procedures (a), (b) and (c) was as follows:

TABLE I

| | (UTS - per) |
|---|---|
| (a) without precarbonizing | 482,000 |
| (b) precarbonizing without hot $N_2$ | 532,000 |
| (c) precarbonizing with hot $N_2$ | 575,000 |

It is seen from the table above that the ultimate tensile strength of the carbon fibers produced according to procedure (c) of the invention was substantially higher than in the case of procedures (a) and (b), not utilizing the precarbonizing features and conditions of the invention process.

EXAMPLE V

3K Mitsubishi polyacrylonitrile tow was processed to produce carbon fibers, by oxidizing, precarbonizing and carbonizing, the oxidizing and carbonizing taking place at substantially under the same conditions as in Example I above, and wherein the oxidized tow was precarbonized in a precarbonizing furnace of the type illustrated in FIGS. 2–4 of the drawing, under the processing conditions shown in Table II below.

TABLE II

| | |
|---|---|
| Process Parameters | |
| Precursor | Mitsubishi |
| Filament Count | 3K |
| Number of Ends | 599 |
| Total Number of Filaments | 1,800,000 |
| Precarbonizer | |
| Temperatures: | |
| Zone I | 400° C. |
| Zone II | 640° C. |
| Zone III | 600° C. |
| East Bot. Sparger $N_2$ Temperature | 430° C. |
| West Bot. Sparger $N_2$ Temperature | 419° C. |
| East Bot. Sparger $N_2$ Flow Rate | 550 SCFH |
| West Bot. Sparger $N_2$ Flow Rate | 550 SCFH |
| Top Seal $N_2$ Flow Rate | 1100 SCFH |
| East Bot. Seal $N_2$ Flow Rate | 700 SCFH |
| West Bot. Seal $N_2$ Flow Rate | 700 SCFH |
| Total $N_2$ Flow Rate to Furnace | 4150 SCFH |
| Exit Seal Pressure | 0.095 In. $H_2O$ |
| Entrance Muffle Pressure | 0.1 In. $H_2O$ |
| Entrance Seal Pressure | 0.01 In. $H_2O$ |
| Exit Muffle Pressure | 0.0 In. $H_2O$ |
| Dilution Factor | 15.17 |

The expression "SCFH" in the table above means standard cubic feet per hour, and the dilution factor in the table above is the number of liters of hot nitrogen per gram of carbon fibers.

From the foregoing, it is seen that the invention provides novel procedures for producing carbon fibers from precursor fibers such as polyacrylonitrile, having improved properties, including high tensile strength and freedom from local tar deposits, by employing an oxidizer, precarbonizer and carbonizer, in which the precarbonizing of the oxidized and stabilized fibers is carried out under certain temperature conditions, particularly employing a hot nitrogen purge at a temperature of about 400° C. and employing about 10–17 liters of nitrogen per gram of carbon fibers, while stretching the fibers from about 5% to about 20%. The precarbonizing treatment particularly functions to remove a major portion of volatile products from the fibers in the precarbonizer, to reduce the oxygen content of the fibers at lower temperatures and improve subsequent carbonization, permit stretching of the fibers at more effective lower temperatures to improve physical properties, and by utilization of a hot nitrogen purge gas under the conditions noted above, increasing the rate of production and efficiency, while reducing tar deposition on the fibers to improve tensile strength thereof.

Figure 6:
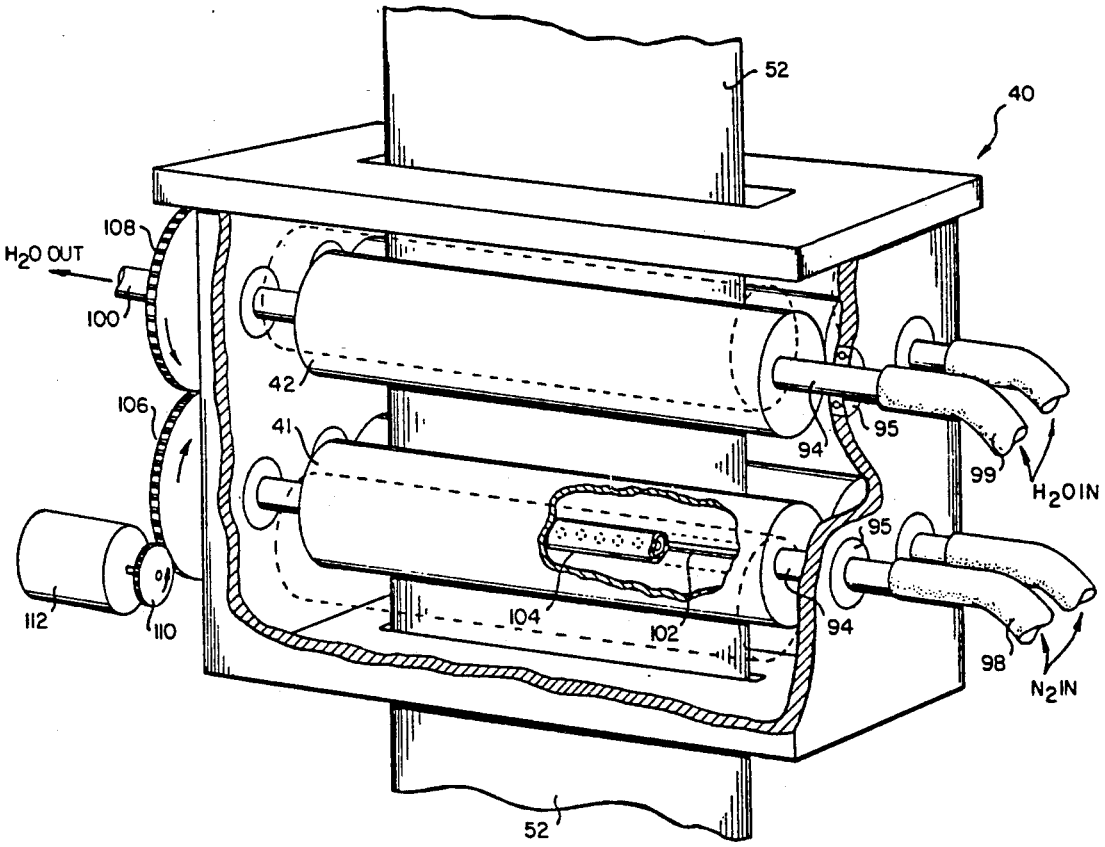
FIG. 6 is a perspective view, partially broken away, of an end seal arrangement that may be employed in the furnace system of FIGS. 2-4.

An advantageous arrangement for the bottom gas seal assembly 40 is shown in FIG. 6, to which reference is now made. The top seal assembly is essentially the same, but with the tubes and spargers reversed in position. Both the pair of gas injection spargers 41 and the pair of water cooled tubes 42 are mounted eccentrically on hollow shafts 94 which rotate within roller bearings 95 mounted in the housing structure 96 for the assembly 40. A flexible gas supply line 98 is coupled to the input side of the sparger 41, while flexible input and output water lines 99, 100 are coupled to the different ends of the water cooled tubes 42. The flexible lines 99, 100 permit an adequate angle of rotation (e.g. 90°) of the associated spargers and tubes to separate the elements of a pair of entry of the fiber tow 52. The spargers 41 each include a longitudinal slit 102 along one side, positioned to be adjacent the tow 52 when the spargers 41 are rotated to closest proximity to each other. An internal plenum 104 within the sparger provides uniform distribution of gas along the length of the slit. At one end of the assembly 40 intercoupled gears 106, 108 mounted on the hollow shafts 94 are rotated between open and closed positions for the spargers 41 and tubes 42 by a drive gear 110 turned by a motor 112. Limit switches (not shown) in the assembly 40 may be in circuit with the motor 112 so as to determine precise open and closed positions for the mechanism and avoid the possibility of an overtravel in either direction. In the position shown in FIG. 6 the spargers 41 and tubes 42 are in operative relation to the tow 52, with sufficient room between the opposed pairs only to pass the tow 52. When the shafts 94 are rotated 90° so as to separate each element of a pair there is adequate space to thread the tow 52 through and also to service the interior of the assembly 40. Similar gears (not visible in FIG. 6) are used to rotate the sparger 41 and tube 42 of each pair toward or away from the fiber tow 52.

This arrangement insures positive pressure inside the furnace 19 and muffle 54 relative to ambient air, and thus avoids the introduction of oxygen that might induce combustion or after the off-gassing process. Both the cold nitrogen and the cooling water provide a substantial thermal barrier to the internal furnace temperature level, and therefore aid in maintaining the desirable temperature gradient of FIG. 5.

Since various changes and modifications of the invention will occur to and can be made readily by those skilled in the art without departing from the invention concept, the invention is not to be taken as limited except by the scope of the appended claims.

What is claimed is:

1. A furnace system for partially carbonizing oxidized fibers, comprising:

a furnace having opposite ends thereof and including an interior heating enclosure, the furnace and enclosure being configured to pass a fiber tow therethrough along a generally planar fiber tow path, and including seal means at the opposite ends, the generally planar fiber tow path extending in a longitudinal direction along a length thereof between the opposite ends;

fiber tow tensioning apparatus with the generally planar fiber tow path;

hot gas source means for producing a thin flowing sheet of heated inert gas in the longitudinal direction along a portion of the length of the generally planar fiber tow path between the seal means, the hot gas source means introducing the inert gas into the generally planar fiber tow path adjacent one of the opposite ends and in the longitudinal direction so that the heated inert gas flows along a substantial portion of the length of the generally planar fiber tow path between the opposite ends with the thin flowing sheet of heated inert gas being generally parallel to the generally planar fiber tow path and the hot inert gases thereof impinging tangentially on the general planar fiber tow path;

means disposed between the furnace and heating enclosure for heating an interior of the heating enclosure to in the range of 300° C. to 700° C. in a midregion of the furnace between the opposite ends; and means defining exit port means adjacent the midregion of the furnace in communication with the interior of the heating enclosure for withdrawing gases therefrom.

2. A system as set forth in claim 1 above, wherein the generally planar fiber tow path has a pair of opposite side edges thereof, the heating enclosure has an interior thereof and the furnace further includes manifold means disposed along the opposite side edges of the generally planar fiber tow path and in communication with both the interior of the heating enclosure and the exit port means.

3. A furnace system for partially carbonizing oxidized acrylic fibers without redeposition of volatiles and tars on the fibers comprising:

a vertical furnace structure having upper and lower portions thereof and including entrance and exit apertures in the upper and lower portions respectively and means for moving a distributed sheet tow of oxidized fibers having a pair of opposite sides thereof upwardly through the furnace structure between the entrance and exit apertures while maintaining tension on the fibers of the tow sufficient to stretch the fibers of the tow in the range of 5–20% under given temperature conditions in the furnace structure;

entrance housing means disposed adjacent the entrance aperture and including entrance seal means positioned adjacent the entrance aperture and disposed to pass the sheet tow of oxidized fibers without ingress of exterior gases, the entrance housing means including a furnace extension section between a bottom of the furnace structure and the entrance seal means;

exit housing means disposed adjacent the exit aperture and including exit seal means positioned adjacent the exit aperture and disposed to pass the sheet tow of oxidized fibers without ingress of exterior gases, the exit housing means including a furnace extension section between a top of the furnace structure and the exit seal means;

heating enclosure means located inside of the furnace structure and encompassing the sheet tow of oxidized fibers within an interior of the heating enclosure means for heating an atmosphere within the interior of the heating enclosure means to a midregion temperature in the range of about 350° C. to about 620° C.; and means disposed adjacent the entrance aperture and within the interior of the heating enclosure means for upwardly injecting heated inert gas in a temperature range in excess of 400° C. adjacent the opposite sides of the sheet tow of oxidized fibers.

4. Apparatus for producing carbon-containing fibers which comprises:

an enclosed insulated body portion having a hollow interior at an inner wall thereof, the hollow interior having a middle zone thereof;

means for advancing a plurality of fibers substantially centrally through the hollow interior of said body portion between entry and exit ends of said body portion;

said advancing means including a first gas seal spaced from the entry end of said body portion externally thereof and a second gas seal spaced from the exit end of said body portion externally thereof;

enclosure means having a hollow interior and disposed about the plurality of fibers between the first and the second gas seals and within the hollow interior of said body portion;

gas sparger means positioned within the hollow interior of the enclosure means adjacent the entry end of said body portion for introducing a gaseous medium into the hollow interior of said enclosure means in a direction from the entry end to the exit end, for impingement on said plurality of fibers and for sweeping off-gassing products away from said plurality of fibers;

means for heating the hollow interior of said enclosure means;

gas outlet ports adjacent the inner wall of said body portion and positioned intermediate the entry and exit ends of said body portion in communication with the hollow interior of the enclosure means; and gas discharge duct means communicating with said outlet ports and disposed adjacent the inner wall of said body portion.

5. The apparatus of claim 4, said enclosure means including a first constricted extension between said second gas seal and the exit end of said body portion and arranged for passage of said fibers therethrough, said constricted extension cooling the fibers and gases and preventing condensing of the off-gassing products from said plurality of fibers in said gas seals.

6. The apparatus of claim 4, including baffle means located within the hollow interior of said body portion between said gas outlet ports and the exit end to substantially prevent off-gassing in the middle zone of the hollow interior of said body portion from proceeding to the exit end of said body portion.

7. The apparatus of claims 4, wherein said enclosure means encompasses the plurality of fibers along the hollow interior of the body portion and wherein the means for heating are disposed between the body portion and the enclosure means.

8. The system of claim 4, including means for heating the gaseous medium prior to introduction into said gas superior means.

9. The apparatus of claim 4, including gas discharge manifold means within the hollow interior gas outlet means adjacent the inner wall of said furnace and positioned intermediate the first end and the second end of said furnace along the interior enclosure and communicating with the hollow interior of the interior enclosure; and a baffle located within the hollow interior of said interior enclosure adjacent said gas outlet means to substantially prevent off-gassing in the middle zone of the hollow interior of said interior enclosure from proceeding to the end of the hollow interior.

10. The apparatus in claim 9, including valve means in said gas discharge duct means for balancing the flow of gases within said enclosure means relative to said plurality of fibers passing through said body portion, to thereby effect uniform flow of gases around said plurality of fibers.

11. The apparatus of claim 10, including an afterburner, said gas discharge duct means communicating with said afterburner for burning volatiles and tars in said gas discharge duct means, and heat exchange means in said afterburner for heating the gaseous medium introduced into said gas sparger means.

12. The apparatus of claim 4, said enclosure means including a first constricted extension between said first gas seal and the entry end of said body portion adapted for passage of said fibers therethrough and a second constricted extension between said second gas seal and the exit end of said body portion adapted for passage of said fibers therethrough, said constricted extensions preventing condensing of the off-gassing products from said plurality of fibers in said first and second gas seals; and means associated with each of said first and second gas seals for maintaining relatively low temperature levels at the entry and exit portions.

13. The apparatus of claim 12, wherein said means for maintaining relatively low temperature levels comprise water cooled means and wherein said first and second gas seals comprise means for injecting relatively low temperature inert gas at positive pressure relative to ambient.

14. The apparatus of claim 13, including valve means in said gas discharge duct means for balancing the flow of gases within said body portion relative to opposite sides of said plurality of fibers passing through said body portion, to thereby effect uniform flow of gases around said plurality of fibers, means for heating the gaseous medium introduced into said gas sparger means, an afterburner, said gas discharge manifold means communicating with said afterburner for burning volatiles and tars in said gas discharge manifold means, and heat exchange means in said afterburner for heating said gaseous medium introduced into said gas sparger means.

15. The apparatus of claim 4, including means for maintaining said plurality of fibers under tension during passage of said plurality of fibers through said body portion.

16. Apparatus for producing carbon-containing fibers which comprises:

an enclosed insulated heating furnace having an inner wall and including an interior enclosure having a hollow interior with a middle zone and an end thereof for passage of a tow of fibers through the hollow interior along a path of travel for the tow of fibers, the tow of fibers having a pair of opposite edges;

means for guiding said tow of fibers substantially centrally through said interior enclosure within the furnace;

first gas seal means disposed adjacent a first end of said furnace and second gas seal means adjacent a second end of said furnace opposite the first end;

a first constricted enclosure between said first gas seal means and the first end of said furnace adapted for passage of said tow of fibers therethrough and a second constructed enclosure between said second gas seal means and the second end of said furnace adapted for passage of said tow of fibers therethrough;

gas sparger means positioned adjacent at least one of the first and second ends of said furnace for introducing a gaseous medium into said interior enclosure, for impingement of said tow of fibers, and for sweeping off-gassing products away from said tow of fibers;

heating means in the furnace adjacent said interior enclosure for heating the interior of the interior enclosure to heat the fibers in a midregion of the furnace; to opposite sides of the path of travel for said tow of fibers through said furnace, to thereby effect uniform flow of gases around said tow of fibers.

17. Apparatus as set forth in claim 16 above, wherein said gas outlet means comprises a pair of manifolds each disposed along a different side of the interior enclosure parallel to and adjacent a different one of the pair of opposite edges of the tow of fibers, and gas ducting means coupled to the pair of manifolds and extracting gases therein outwardly from the furnace.

18. The apparatus of claim 17, said gas sparger means being in the form of a pair of parallel sparger bars positioned horizontally adjacent the first end of said furnace, and positioned on opposite sides of the path of travel for said tow of fibers through said furnace.

19. The apparatus of claim 18, including valve means in said gas ducting means for balancing the flow of gases from the hollow interior of said interior enclosure relative of the body portion and coupled to the gas outlet ports, said gas discharge manifold means being in communication with the gas discharge duct means.

20. The apparatus of claim 19, wherein the gas seal means each comprise a pair of water cooled tubes positioned on opposite sides of the tow of fibers and a pair of cold nitrogen spargers on opposite sides of the tow of fibers, the water cooled tubes being closest to the furnace and the spargers providing positive pressure relative to ambient, and wherein the gas seal means further include means for enlarging the relative spacings between the elements of each pair to provide room for threading the tow of fibers therebetween prior to operation of the apparatus.

21. A furnace system for partially carbonizing oxidized fibers to enable more efficient and reliable subsequent carbonization comprising;

a principal heating enclosure disposed along and about a generally planar path along which oxidized fibers move as a tow between opposite first and second ends of the heating enclosure within a hollow interior of the heating enclosure having an intermediate region thereof;

means for feeding the fibers as a tow along the generally planar path through the heating enclosure between the opposite first and second ends of the heating enclosure;

first fiber heating means comprising means for supplying heated inert gas disposed adjacent the fibers and adjacent the first end of the enclosure along the generally planar path and including means for directing hot inert gases along the fibers into communication with the fibers, the first fiber heating means directing a thin flowing sheet of the heated inert gas along a portion of a length of the tow between the opposite first and second ends of the heating enclosure, the thin flowing sheet being generally parallel to the tow with the hot gases thereof impinging on the tow of fibers in generally tangential fashion in a direction along the generally planar path from the first end to the second end of the heating enclosure;

second fiber heating means disposed along the generally planar path for increasing the temperature of the fibers above the temperature of the hot inert gases within the heating enclosure;

gas exhaust means in communication with the hollow interior of the heating enclosure for withdrawing off-gasses products and gases from contact with the fibers in the intermediate region of the hollow interior of the heating enclosure; and seal means disposed at the opposite first and second ends of the heating enclosure for substantially blocking the flow of exterior air into the hollow interior of the heating enclosure.

22. Apparatus as set forth in claim 21 above, wherein the first fiber heating means comprises elongated spargers disposed transverse to the generally planar path and substantially parallel thereto.

23. A furnace system for partially carbonizing previously oxidized fibers to enable more efficient and reliable subsequent carbonization comprising:

a principal heating enclosure disposed along and about an axis along which oxidized fibers move and having an interior with an intermediate region and opposite first and second end portion of the enclosure;

means for feeding a tow of the fibers distributed in a planar sheet along the axis through the heating enclosure;

first fiber heating means comprising elongated spargers disposed transverse to the planer sheet and substantially parallel thereto for supplying heated inert gas disposed adjacent the fibers and adjacent the first end portion of the heating enclosure along the axis and including means for directing hot inert gases along the fibers into communication with the fibers;

second fiber heating means disposed along the axis for increasing the temperature of the fibers above the temperature of the hot inert gases within the heating enclosure;

gas exhaust means in communication with the interior of the heating enclosure for withdrawing off-gassed products and gases from contact with the fibers in the intermediate region of the interior of the heating enclosure;

seal means disposed at opposite ends of the heating enclosure for substantially blocking the flow of exterior air into the interior of the heating enclosure;

end enclosures at the opposite first and second ends of the heating enclosure, the end enclosures having substantially smaller cross-sectional areas than the heating enclosure;

the seal means comprising pairs of tubes straddling the axis;

variable speed tensioning stands coupled to the fibers moving through the furnace adjacent the opposite first and second ends of the furnace system; and means for driving the tensioning stands with differential velocities such that stretch in the range of 5–20% is imparted to the fibers passing through the furnace system.

24. Apparatus as set forth in claim 23 above, wherein the means for supplying heated inert gas comprises preheating means for preheating inert gas and means for mixing lower temperature inert gas with preheated inert as to provide a selected inert gas temperature level at the fibers, and wherein the gas exhaust means comprise insulated gas piping systems communicating with the intermediate region of the interior of the heating enclosure at a number of different portions of the heating enclosure.

25. A furnace system for partially carbonizing oxidized acrylic fibers without redeposition of volatiles and tars on the fibers comprising:

a furnace structure having opposite entrance and exit portions thereof and including entrance and exit apertures in the entrance and exit portions respectively and means for moving a distributed sheet tow of oxidized fibers having a pair of opposite sides thereof through the furnace structure between the entrance and exit apertures while maintaining tension on the fibers of the tow sufficient to stretch the fibers of the tow in the range of 5–20% under given temperature conditions in the furnace structure;

entrance housing means disposed adjacent the entrance aperture and including entrance seal means positioned adjacent the entrance aperture and disposed to pass the sheet tow of oxidized fibers without ingress of exterior gases, the entrance housing means including a furnace extension section between a first end of the furnace structure and the entrance seal means;

exit housing means disposed adjacent the exit aperture and including exit seal means positioned adjacent the exit aperture and disposed to pass the sheet tow of oxidized fibers without ingress of exterior gases, the exit housing means including a furnace extension section between a second end of the furnace structure opposite the first end and the exit seal means;

heating enclosure means located inside of the furnace structure and encompassing the sheet tow of oxidized fibers within an interior of the heating enclosure means for heating an atmosphere within the interior of the heating enclosure means to a midregion temperature in the range of about 350 ° C. to about 620° C.; and means disposed adjacent the entrance aperture and within the interior of the heating enclosure means for injecting heated inert gas generally parallel to the generally planar sheet tow wherein the hot gases thereof impinge tangentially on the opposite sides of the generally planar sheet tow of oxidized fibers.

26. The apparatus of claim 25, wherein the means disposed adjacent the entrance aperture and within the interior of the heating enclosure means injects inert gas heated to a temperature sufficient to produce an onset of decomposition of the distributed sheet tow of oxidized fibers.

27. Apparatus for producing carbon-containing fibers which comprises:

an enclosed insulated body portion having a hollow interior at an inner wall thereof, the hollow interior having a middle zone thereof;

means for advancing a plurality of fibers substantially centrally through the hollow interior of said body portion between entry and exit ends of said body portion;

said advancing means including a first gas seal spaced from the entry end of said body portion externally thereof and a second gas seal spaced from the exit end of said body portion externally thereof;

enclosure means having a hollow interior and disposed about the plurality of fibers between the first and the second gas seals and within the hollow interior of said body portion;

means positioned within the hollow interior of the enclosure means adjacent the entry end of said body potion for introducing a gaseous medium into the hollow interior of said enclosure means in a direction from the entry end to the exit end, for impingement tangentially on said plurality of fibers in a direction along the generally planar path from the entry end to the exit end of the hollow interior and for sweeping off-gassing products away from aid plurality of fibers;

means for heating the hollow interior of said enclosure mean;

gas outlet ports adjacent the inner wall of said body potion and positioned between the entry and exit ends of said body portion in communication with the hollow interior of the enclosure means; and gas discharge duct means communicating with said outlet ports and disposed adjacent the inner wall of said body portion.

* * * * *